US008863357B1

(12) United States Patent
Chang

(10) Patent No.: US 8,863,357 B1
(45) Date of Patent: Oct. 21, 2014

(54) ADJUSTABLE DOOR CLOSER

(71) Applicant: Hui-Chen Chang, Xinwu Township, Taoyuan County (TW)

(72) Inventor: Hui-Chen Chang, Xinwu Township, Taoyuan County (TW)

(73) Assignee: Heng Kuo Co., Ltd, Daxi Township, Taoyuan County (TW)

( * ) Notice: Subject to any disclaimer, the term of this patent is extended or adjusted under 35 U.S.C. 154(b) by 0 days.

(21) Appl. No.: 13/889,532

(22) Filed: May 8, 2013

(51) Int. Cl.
*E05F 1/08* (2006.01)
*E05F 3/12* (2006.01)

(52) U.S. Cl.
CPC ..... *E05F 3/12* (2013.01)
USPC ..... 16/72; 16/78; 16/56; 16/71; 16/49

(58) Field of Classification Search
USPC ..... 16/72, 71, 80, 49, 51, 56, 78, 58, 16/DIG. 9, DIG. 10, DIG. 17, 65, 53
See application file for complete search history.

(56) References Cited

U.S. PATENT DOCUMENTS

| | | | | |
|---|---|---|---|---|
| 3,137,888 | A * | 6/1964 | Blom | 16/51 |
| 3,545,030 | A * | 12/1970 | Perry | 16/55 |
| 5,666,692 | A * | 9/1997 | Toledo | 16/80 |
| 5,829,097 | A * | 11/1998 | Toledo | 16/53 |
| 6,397,430 | B1 * | 6/2002 | Brown et al. | 16/71 |
| 6,493,904 | B1 * | 12/2002 | Chiang | 16/56 |
| 7,921,511 | B2 * | 4/2011 | Johnson | 16/60 |
| 2003/0070255 | A1 * | 4/2003 | Huang | 16/60 |
| 2004/0088822 | A1 * | 5/2004 | Huang | 16/60 |
| 2007/0067950 | A1 * | 3/2007 | Johnson | 16/63 |
| 2007/0234510 | A1 * | 10/2007 | Toledo | 16/72 |
| 2008/0034535 | A1 * | 2/2008 | Chiang | 16/60 |
| 2011/0030167 | A1 * | 2/2011 | Chiang et al. | 16/78 |

FOREIGN PATENT DOCUMENTS

JP 10280794 A * 10/1998

* cited by examiner

*Primary Examiner* — Chuck Mah
(74) *Attorney, Agent, or Firm* — Egbert Law Offices, PLLC

(57) ABSTRACT

An adjustable door closer has a hollow pedestal with a first and a second chamber as well as an actuating groove. An actuating device is set into the actuating groove. A first piston assembly is set into the first chamber and a second piston assembly set into the second chamber. A partition wall is formed between the first and second chambers. Due to a laterally configured flow resistance unit, the holes to be set into the first and second chambers are reduced to three, including a connecting hole and first and second backflow bypass holes, all of which are connected only to the second chamber from the partition wall. As such, the flow path structure is simplified compared to the five holes required for typical structures. The adjustable door closer could reduce significantly the manufacturing cost and realize better regulating functions with improved applicability and economic benefits.

1 Claim, 9 Drawing Sheets

ADJUSTABLE DOOR CLOSER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an accessory unit for a rotary door panel, and more particularly to an innovative one which is designed into an adjustable door closer.

2. Description of Related Art Including Information Disclosed Under 37 CFR 1.97 and 37 CFR 1.98.

The so-called "door closer" is generally mounted onto the rotating shaft seat of a rotary door panel to control the closing speed of the door panel.

In view of the shortcomings of traditional door closer structures wherein only spring force is used to control the closing speed of door panel with excessive or insufficient resistance or inadequate adjusting function, an adjustable door closer structure has been developed accordingly. As per structural principle of said adjustable door closer for controlling the closing speed of door panel, the spring force is combined with the backflow channel of lubricating oil and throttle valve to adjust the closing speed of door panel via the resistance of the lubricating oil.

Yet, there still lack of some shortcomings in the conventional structure of said adjustable door closer, which are illustrated in the following figures. FIGS. 1-3 depict a conventional adjustable door closer, wherein a hollow pedestal 10 is fitted with a first chamber 11 and second chamber 12 filled with lubricating oil. One end of the first and second chambers 11, 12 is connected with an actuating groove 13, which is provided with an actuating seat 14 and a driving shaft 15 driven by the door panel. The driving shaft 15 is linked to a cam 16 that can drive the actuating seat 14 to generate translational movement during its rotation. Moreover, a first piston 113 and a first spring 115 are installed into the first chamber 11. The first piston 113 is linked to the actuating seat 14 via a first link rod 116. A second piston 123 and a second spring 125 are installed into the second chamber 12. The second piston 123 is linked to the actuating seat 14 via a second link rod 126. In case of translational movement of the actuating seat 14, the first and second pistons 113, 123 can be driven simultaneously to compress the first and second springs 115, 125 to accumulate spring force. Of which, a one-way check valve 117 is set on the end surface of the first piston 113. Moreover, a first connecting duct 21 and second connecting duct 22 are arranged separately onto the partition wall 17 between the first and second chambers 11, 12 so as to connect the first and second chambers 11, 12. Of which, a first regulating valve 213 is set at middle position of the first connecting duct 21, and a second regulating valve 223 set at middle position of the second connecting duct 22, so as to regulate the flow speed of lubricating oil in the first and second chambers 11, 12 and control the closing speed of the door panel. Moreover, a cutting plane 18 is formed laterally on the periphery of the first piston 113, and a through-hole 180 penetrates radially the first piston 113 from the cutting plane 18, such that lubricating oil in the second chamber 12 could flow to the first piston 113 and actuating groove 13 through the first connecting duct 21, cutting plane 18 and through-hole 180.

However, it is still observed in actual applications that, the first and second connecting ducts 21, 22 linking the first and second chambers 11, 12 along with a through-hole 180 are set on the partition wall 17, so five holes will be formed on the first and second chambers 11, 12, leading to higher manufacturing cost and defects. On the other hand, the cutting plane 18 set on the periphery of the first piston 113 must be molded through secondary processing after molding of the first piston 113, leading also to increase of manufacturing cost; besides, both end surfaces of the first and second pistons 113, 123 are of closed surfaces, so the substrate is made of solid metal with higher material cost. On the whole, there is still a room for innovative development due to shortcomings of conventional adjustable door closer such as higher manufacturing cost and poor economic benefits.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

In the present invention, based on the technical characteristics of a laterally configured flow resistance unit, the holes to be set into the first and second chambers are reduced to three, i.e.: no connecting hole, first and second backflow bypass holes, all of which are connected only to the second chamber from the partition wall. As such, the flow path structure is simplified (note: five holes are required for typical structures) to cut down the manufacturing cost and defects.

Based on the technical characteristics wherein an axial through-hole is set onto the first piston head of the first piston assembly, the axial center of the first piston head allows for free flow of lubricating oil, hence, so only hollow tubing material is required to minimize the cost of materials and manufacturing.

The periphery of the second piston head must not be molded into the cutting plane 18 of the typical structure through secondary processing (shown in FIG. 1, 3). This could further reduce the manufacturing costs.

DETAILED DESCRIPTION OF THE INVENTION

Figure 1:
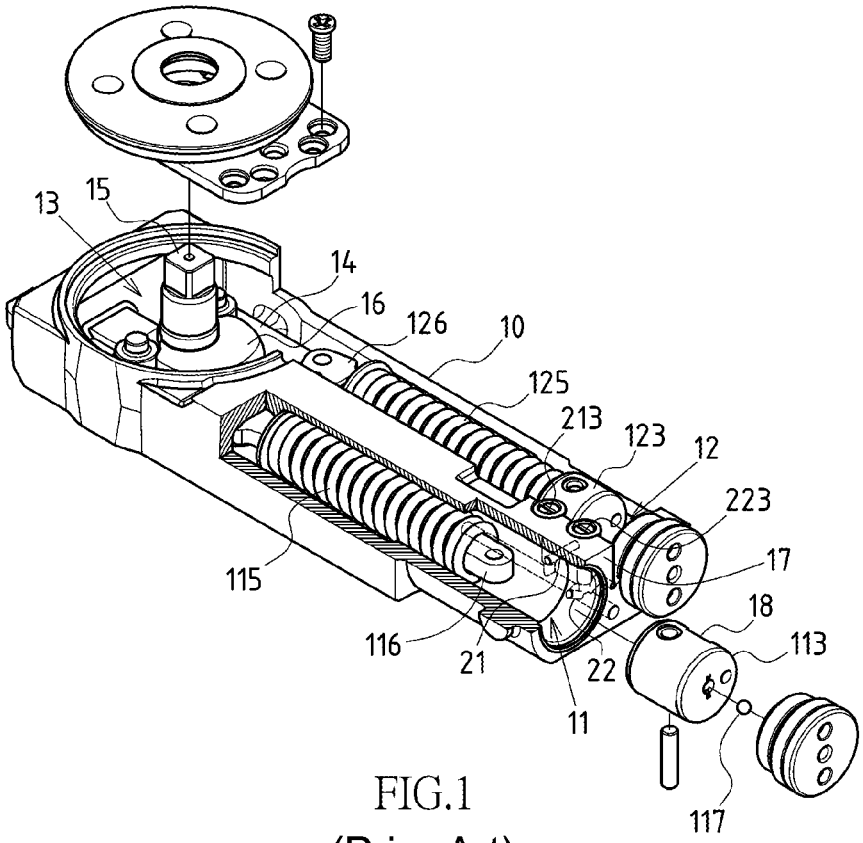
FIG.1 (Prior Art)
FIG. 1 is a perspective view of a typical structure (note: partial sectional and exploded view).
Figure 2:
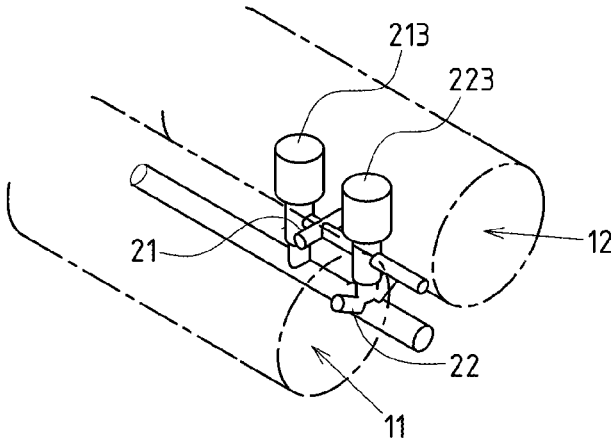
FIG.2 (Prior Art)
FIG. 2 is a perspective schematic view of flow path distribution of a typical structure.
Figure 3:
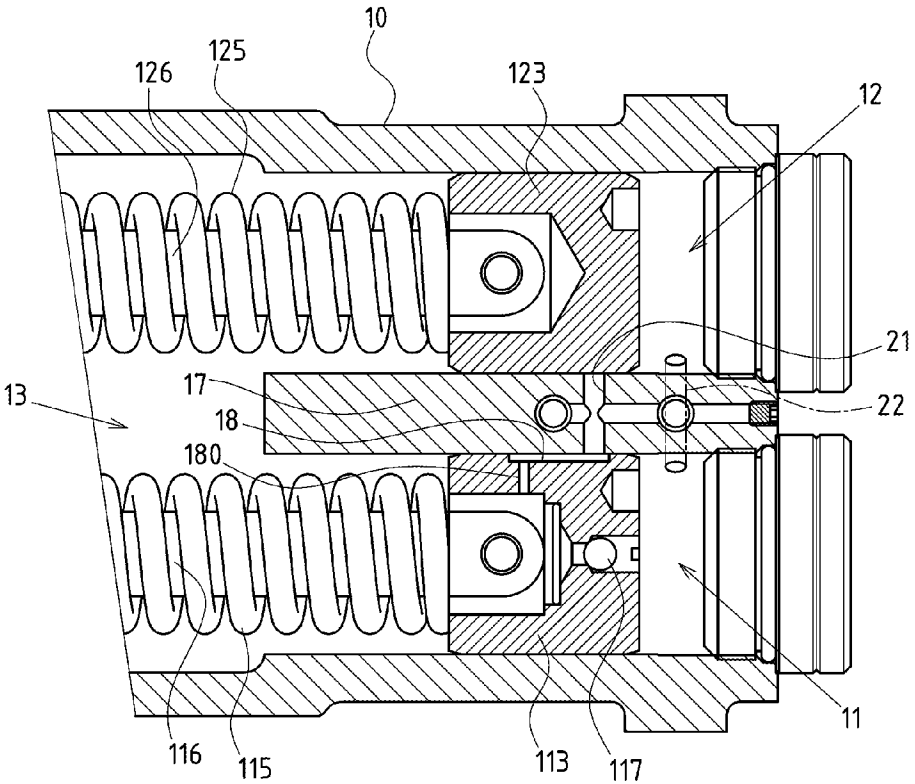
FIG.3 (Prior Art)
FIG. 3 is a partial plain sectional view of a typical structure.
Figure 4:
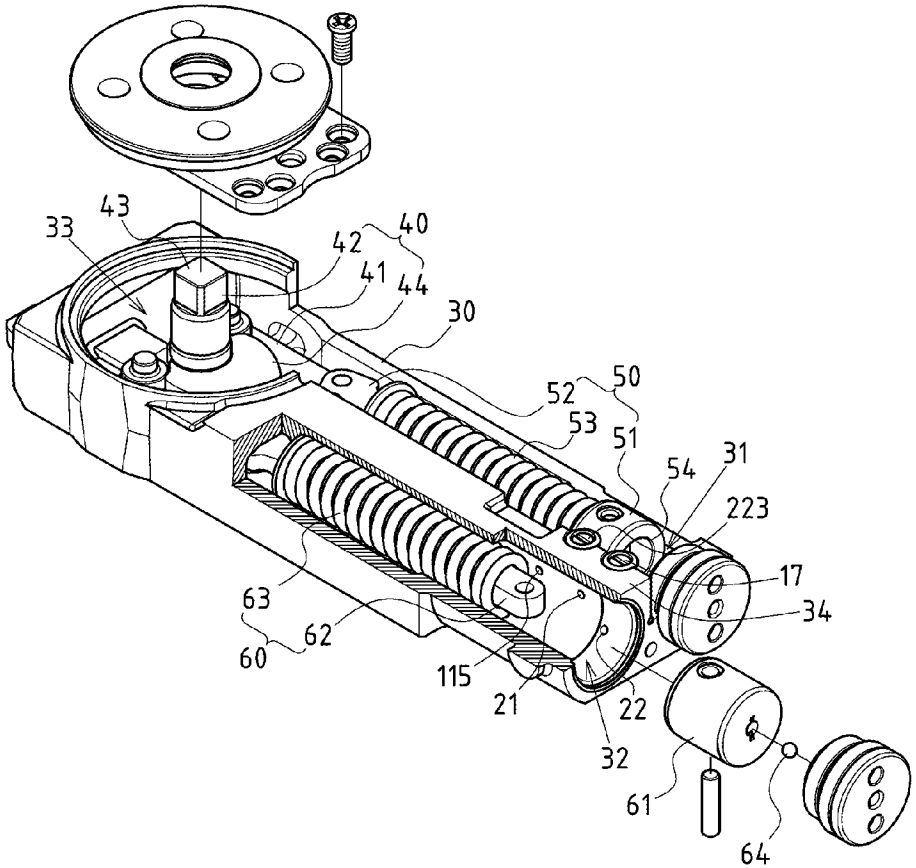
FIG. 4 is a perspective view of the preferred embodiment of the present invention (note: partial sectional and exploded view).
Figure 5:
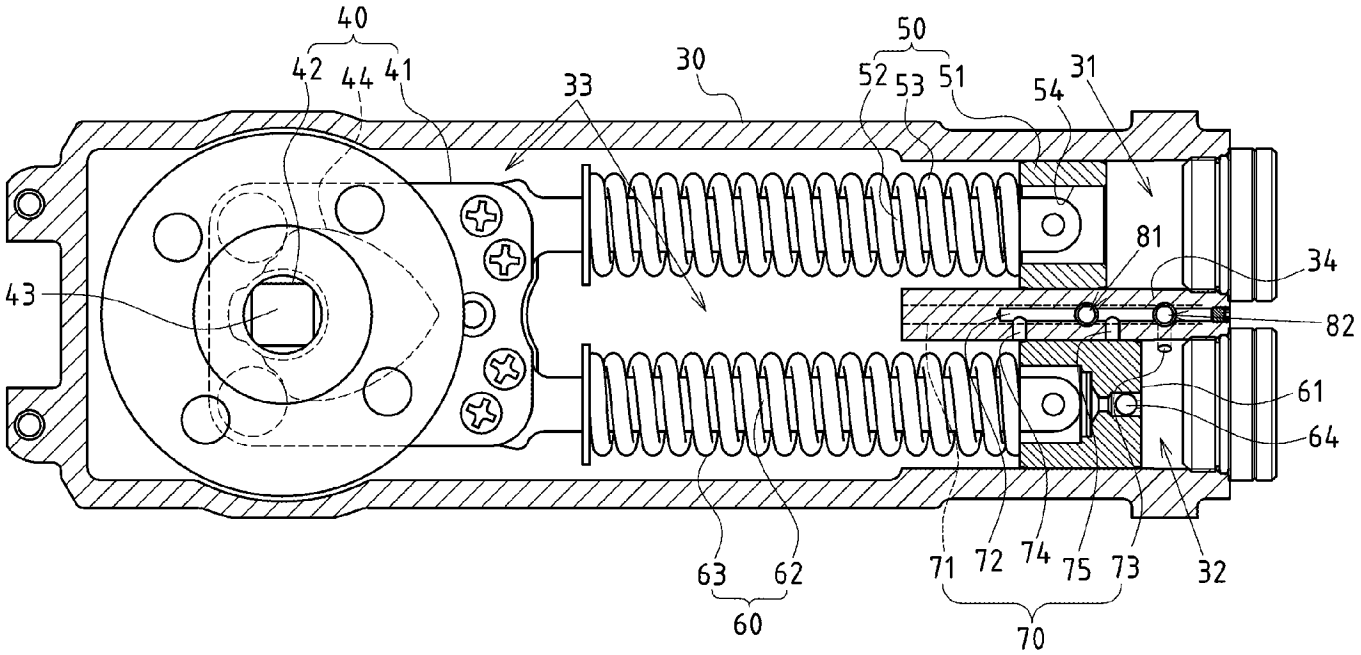
FIG. 5 is a transverse plain sectional view of the preferred embodiment of the present invention.
Figure 6:
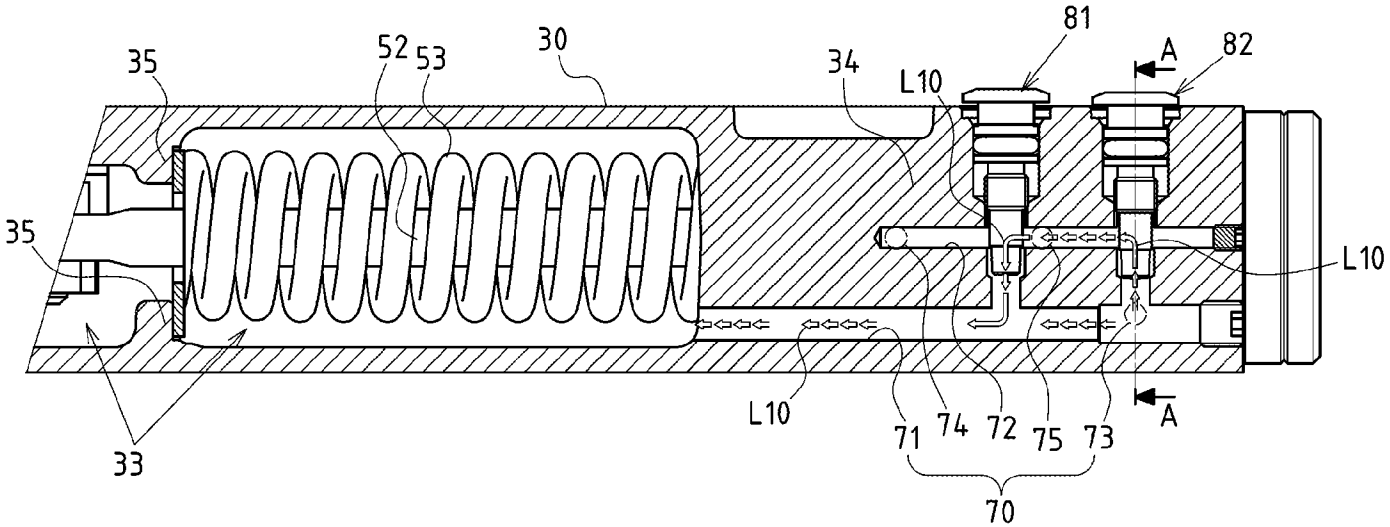
FIG. 6 is a partial vertical sectional view of the preferred embodiment of the present invention.
Figure 7:
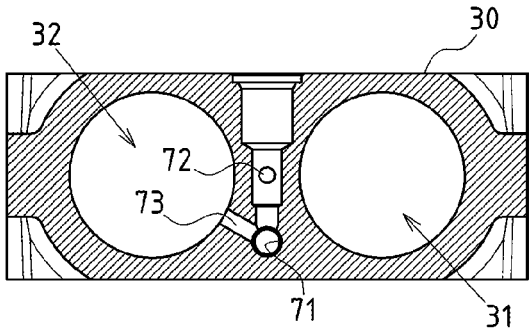
FIG. 7 is an A-A sectional view of FIG. 6.
Figure 8:
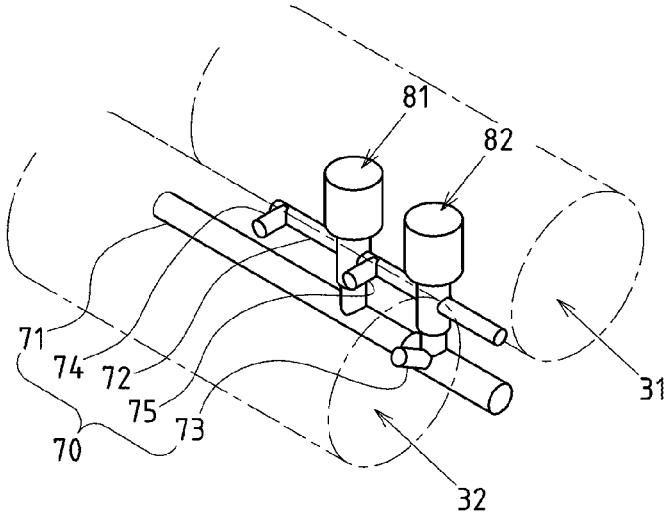
FIG. 8 is a perspective schematic view of the flow path distribution of the present invention.
Figure 9:
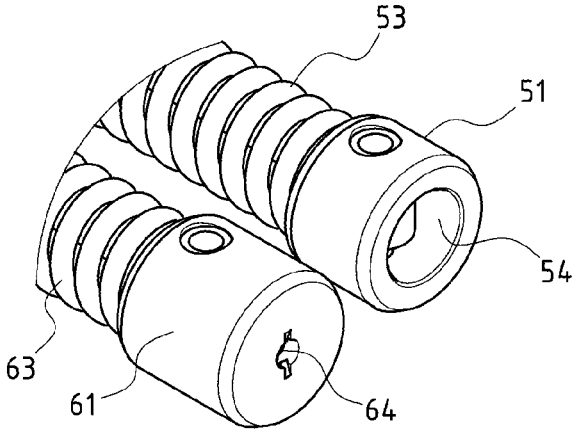
FIG. 9 is a perspective comparison view of the first and second piston heads of the present invention.

FIGS. 4-9 depict preferred embodiments of the adjustable door closer of the present invention, which, however, are provided for only explanatory objective. Said adjustable door closer comprises a hollow pedestal 30, consisting of a first chamber 31 and a second chamber 32 filled with lubricating oil (not shown), as well as an actuating groove 33 linked to the same side of the first and second chambers 31, 32. Of which, a partition wall 34 is formed between the first and second chambers 31, 32.

An actuating device 40 is set into the actuating groove 33 of the hollow pedestal 30, consisting of an actuating seat 41 and a driving shaft 42. The driving shaft 42 is provided with a driven end 43 protruding out of the hollow pedestal 30 (note: the driven end 43 is driven by existing door panel), and the driving shaft 42 is linked to a cam 44 that can drive the actuating seat 14 to generate translational movement during its rotation.

A first piston assembly 50 is set into the first chamber 31 of the hollow pedestal 30, consisting of a first piston head 51, a first link rod 52 and a first spring 53. Of which, the first piston head 51 could slide back and forth in the first chamber 31, the first link rod 52 is used to link the first piston head 51 and the actuating seat 41 of the actuating device 40, and the first spring 53 is assembled between the first piston head 51 and a stopper surface 35 (only marked in FIG. 6) of the actuating groove 33.

An axial through-hole 54 is formed axially onto the first piston head 51 of the first piston assembly 50 (indicated by FIG. 5), such that the axial center of the first piston head 51 allows for free flow of lubricating oil.

A second piston assembly 60 is set into the second chamber 32 of the hollow pedestal 30, consisting of a second piston head 61, a second link rod 62 and a second spring 63. Of which, the second piston head 61 could slide back and forth in the second chamber 32, the second link rod 62 is used to link the second piston head 61 and the actuating seat 41 of the actuating device 40, and the second spring 63 is assembled between the second piston head 61 and the stopper surface 35 (only marked in FIG. 6) of the actuating groove 33. Moreover, a check valve 64 is mounted onto one end of the second piston head 61, so as to control the flow of lubricating oil only from the actuating groove 33 to the second chamber 32, or otherwise it is under a closed state.

A laterally configured flow resistance unit 70 is set onto the partition wall 34 formed between the first and second chambers 31, 32, consisting of a primary backflow channel 71 and a secondary backflow channel 72 set along the extended direction of the partition wall and also configured vertically at interval. Of which, both ends of the secondary backflow channel 72 are closed, while one end of the primary backflow channel 71 is closed, and the other end linked to the actuating groove 33; one side of the primary backflow channel 71 is linked to the second chamber 32 via a connecting hole 73, and one side of the secondary backflow channel 72 is linked to the second chamber 32 via the first and second backflow bypass holes 74, 75. When the second piston head 61 is not actuated, the second backflow bypass hole 75 is blocked off.

A first-section regulating valve 81 is set onto the partition wall 34 correspondingly to the primary and secondary backflow channels 71, 72. The regulating position of the first-section regulating valve 81 is located between the primary backflow channel 71 and the first backflow bypass hole 74 of the secondary backflow channel 72 (indicated in FIG. 6).

A second-section regulating valve 82 is set onto the partition wall 34 correspondingly to the primary and secondary backflow channels 71, 72. The regulating position of the second-section regulating valve 82 is located between the primary backflow channel 71 and the second backflow bypass hole 75 of the secondary backflow channel 72 (indicated in FIG. 6).

Figure 10:
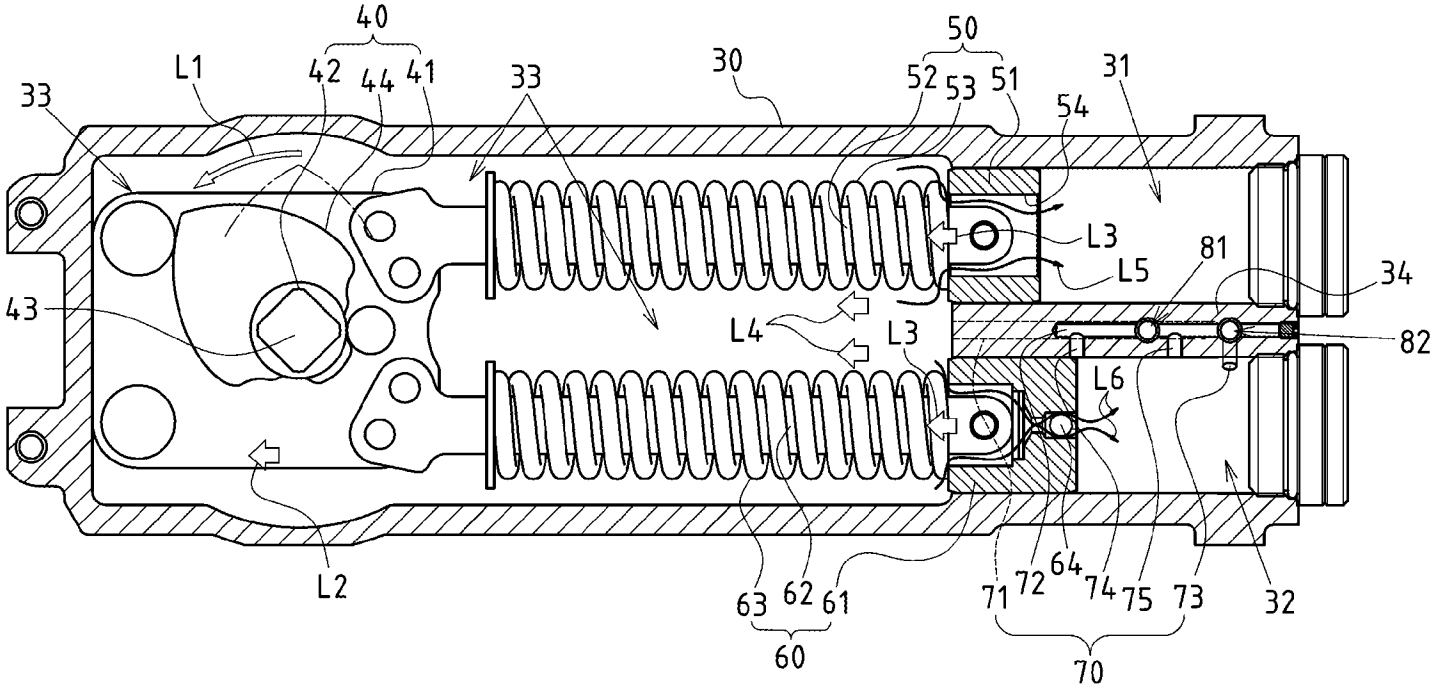
FIG. 10 is an actuating view 1 of the present invention.
Figure 11:
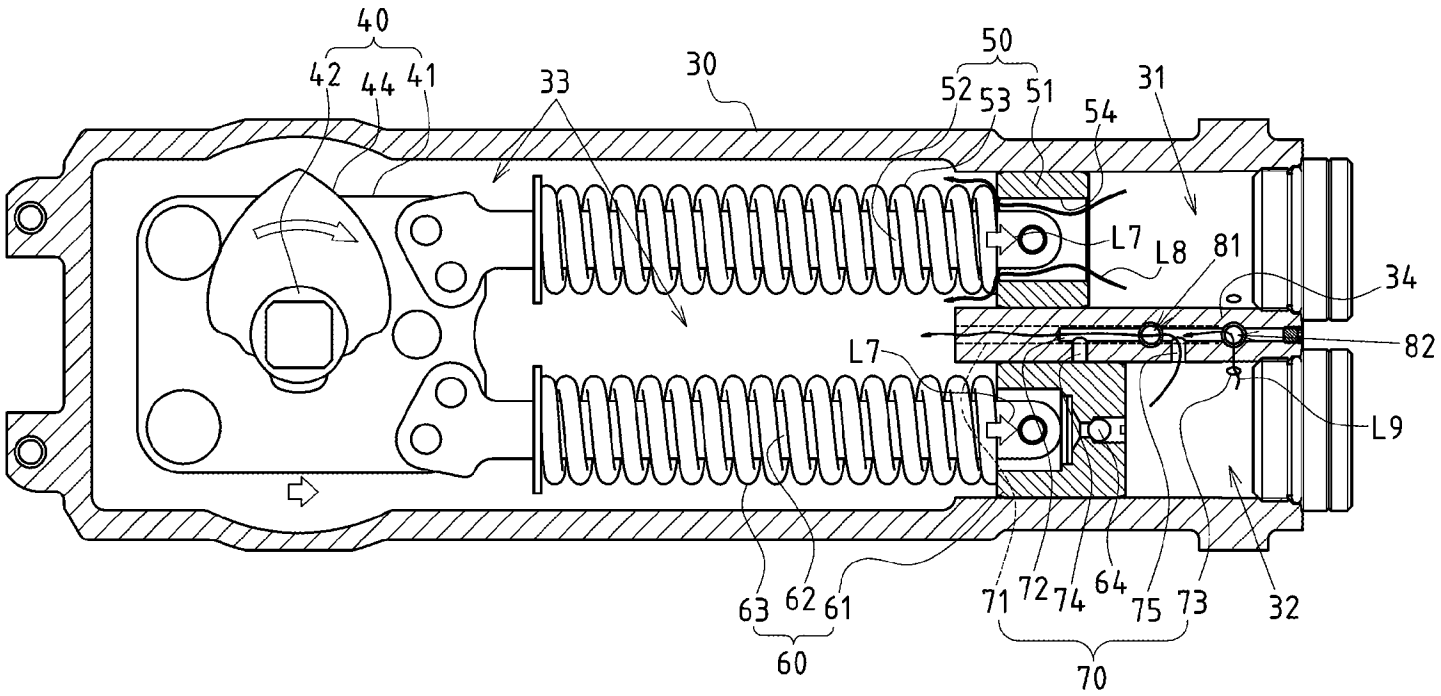
FIG. 11 is an actuating view 2 of the present invention.
Figure 12:
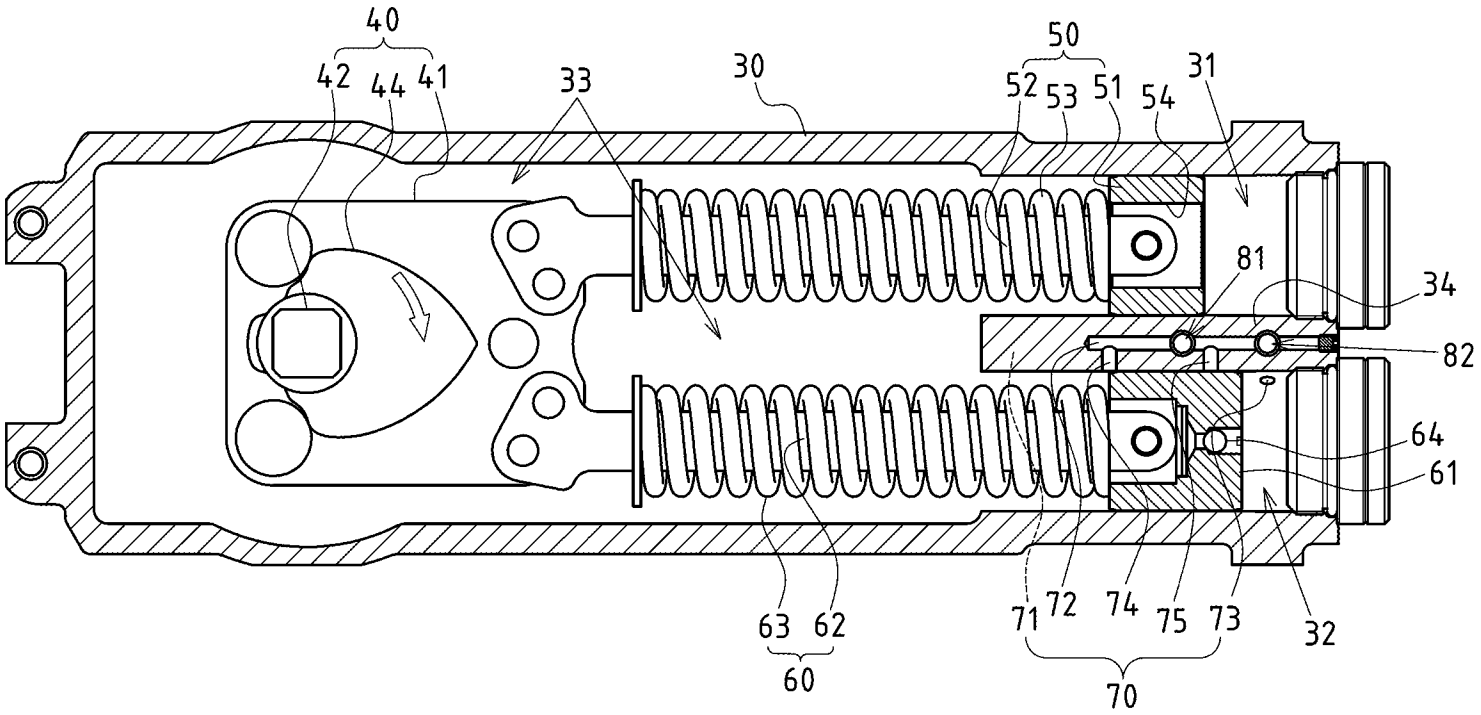
FIG. 12 is an actuating view 3 of the present invention.

Based upon above-specified structural design, the present invention is operated as follows: referring to FIG. 10, when the driven end 43 of the actuating seat 41 along with the cam 44 is driven by existing door panel (not shown in the figure) (marked by arrow L1), the actuating seat 41 is driven to move leftwards (marked by arrow L2), such that the first and second piston heads 51, 61 also move leftwards in the first and second chambers 31, 32 (marked by arrow L3). In this process, the first and second springs 53, 63 are compressed (marked by arrow IA) to accumulate elastic force. On the other hand, when the space of the first chamber 31 is expanded with the shift of the first piston head 51, lubricating oil in the actuating groove 33 will flow from the first piston head 51 to the first chamber 31 through axial through-hole 54 (marked by arrow L5). When the space of the second chamber 32 is expanded with the shift of the second piston head 61, lubricating oil in the actuating groove 33 will flow from the second piston head 61 to the second chamber 32 through the check valve 64 (marked by arrow L6). When the actuating seat 41 shifts to predefined maximum stroke, the connecting hole 73, first backflow bypass hole 74 and second backflow bypass hole 75 of the laterally configured flow resistance unit 70 are linked to the second chamber 32. FIG. 11 also depicts a schematic view that the adjustable door closer enters into auto-closing phase, during which the first and second piston heads 51, 61 in the first and second chambers 31, 32 are turned to move rightwards for resetting (marked by arrow L7) with the elastic release action of the first and second springs 53, 63. During resetting of the first and second piston heads 51, 61, the closing speed could be reduced with the flow path design of the laterally configured flow resistance unit 70. Referring to FIG. 11, when the first and second piston heads 51, 61 move back rightwards, lubricating oil in the first chamber 31 will flow back to the actuating groove 33 through the axial through-hole 54 (marked by arrow L8). In this case, the check valve 64 is under a non-return state, so lubricating oil in the second chamber 32 cannot flow into the actuating groove 33 through the check valve 64, but a predetermined amount of lubricating oil in the second chamber 32 will flow back into the actuating groove 33 through connecting hole 73 (marked by arrow L9), and the predetermined amount of lubricating oil permits to regulate its backflow flow rate and in turn the closing speed of the door, based on the switching change of the first and second backflow bypass holes 74, 75 and the flow regulating state of the first and second regulating valves 81, 82. Referring to FIG. 11, when the second piston head 61 continuously shifts towards the resetting direction, the first backflow bypass hole 74 is blocked off by the second piston head 61, while the second backflow bypass hole 75 and connecting hole 73 are kept in open state. In such a case, lubricating oil in the second chamber 32 could flow back to the actuating groove 33 through the second backflow bypass hole 75 and connecting hole 73 (note: the backflow flow path of lubricating oil is indicated by arrow L10 in FIG. 6). With continuous movement of the second piston head 61, the first and second backflow bypass holes 74, 75 will be blocked off first by the second piston head, and then afterward, referring to FIG. 12, only the second backflow bypass hole 75 is blocked off. As disclosed in FIGS. 10-12, due to the variable length of the backflow flow path of lubricating oil along with predefined flow regulation of the first and second regulating valves 81, 82, the adjustable door closer could be operated in two sections (quickly and then slowly) with desired functions and effects.

I claim:

1. An adjustable door closer comprising:

a hollow pedestal, comprising a first chamber and a second chamber filled with lubricating oil as well as an actuating groove linked to respective ends of the first and second chambers; a partition wall is formed between the first and second chambers;

an actuating device, set into the actuating groove of the hollow pedestal, comprising an actuating seat and a driving shaft; the driving shaft is provided with a driven end protruding out of the hollow pedestal, and the driving shaft has a cam that can drive the actuating seat to generate translational movement during rotation of the shaft;

a first piston assembly, set into the first chamber of the hollow pedestal, comprising a first piston head, a first link rod and a first spring; the first piston head is configured to slide back and forth in the first chamber, the first link rod links the first piston head and the actuating seat of the actuating device, and the first spring is assembled on the first link rod between the first piston head and a stopper surface of the actuating groove;

an axial through-hole, formed axially onto the first piston head of the first piston assembly, such that the axial center of the first piston head allows for free flow of lubricating oil;

a second piston assembly, set into the second chamber of the hollow pedestal, comprising a second piston head, a second link rod and a second spring, the second piston head is configured to slide back and forth in the second chamber, the second link rod links the second piston head and the actuating seat of the actuating device, and the second spring is assembled on the second link rod between the second piston head and the stopper surface of the actuating groove; a check valve is mounted onto one end of the second piston head, so as to allow the flow of lubricating oil only from the actuating groove to the second chamber, or otherwise the check valve is under a closed state;

a laterally configured flow resistance unit, set onto the partition wall formed between the first and second chambers, comprising a primary backflow channel and a secondary backflow channel set along the extended direction of the partition wall and also configured vertically at interval; wherein both ends of the secondary backflow channel are closed, while one end of the primary backflow channel is closed, and the other end is linked to the actuating groove; the primary backflow channel is linked to the secondary chamber via a connecting hole adjacent to the closed end of said primary backflow channel, and the secondary backflow channel is linked to the second chamber via a first backflow bypass hole and a second backflow bypass hole; wherein said first backflow bypass hole, said second backflow bypass hole and said connecting hole are positioned in that order along the extended direction of the extended wall, such that when the second piston head is not actuated, only the second backflow bypass hole is blocked off by the second piston head;

a first-section regulating valve, set onto the partition wall correspondingly to the primary and secondary backflow channels; and the regulating position of the first-section regulating valve is configured to regulate the oil flow between the primary backflow channel and the first backflow bypass hole of the secondary backflow channel;

a second-section regulating valve, set onto the partition wall correspondingly to the primary and second backflow channels; and the regulating position of the second-section regulating valve is configured to regulate the oil flow between the primary backflow channel and the second backflow bypass hole of the secondary backflow channel.

* * * * *